US006481017B2

(12) United States Patent
Mullis

(10) Patent No.: US 6,481,017 B2
(45) Date of Patent: Nov. 19, 2002

(54) METHOD OF USING REMOVABLE ARM BAND FOR SAFETY PURPOSE IN HUNTING

(76) Inventor: James Mullis, 915 Park St., Troy, AL (US) 36081

( * ) Notice: Subject to any disclaimer, the term of this patent is extended or adjusted under 35 U.S.C. 154(b) by 0 days.

(21) Appl. No.: 10/032,570

(22) Filed: Jan. 2, 2002

(65) Prior Publication Data

US 2002/0083507 A1 Jul. 4, 2002

Related U.S. Application Data

(60) Provisional application No. 60/296,133, filed on Jun. 7, 2001, provisional application No. 60/259,673, filed on Jan. 5, 2001, and provisional application No. 60/259,212, filed on Jan. 3, 2001.

(51) Int. Cl.[7] ..... A41D 13/00

(52) U.S. Cl. ..... 2/69; 2/16

(58) Field of Search ..... 2/16, 22, 24, 59, 2/60, 79, 170, 910, 911, 917, 919; 428/919

(56) References Cited

U.S. PATENT DOCUMENTS 4,494,245 A * 1/1985 Burkhead et al. ..... 2/2.1
D302,136 S * 7/1989 Müller ..... D10/111
5,159,718 A * 11/1992 Moyer ..... 2/69
6,182,291 B1 * 2/2001 Garvey ..... 2/102
6,243,867 B1 * 6/2001 Faison ..... 2/16

OTHER PUBLICATIONS

Red Head, Archery Specialists Catalog, 1997 p. 77—5–in–1 cover–up—Blaze Orange & Real Tree Camo.*

Herter's—1997 Catalog, p. 22—Reversible–Camo & Blaze Railroad Cap & Reversible Fleece Gaitor of Blaze Orange & Camo.*

* cited by examiner

*Primary Examiner*—Gloria M. Hale
(74) *Attorney, Agent, or Firm*—Clark & Brody

(57) ABSTRACT

A hunting apparel comprises a band having opposing elasticized ends, or made of elastic material. One side of the band is hunter orange, and the other side is a camouflage. The band is sized to expose the required area of hunter orange to meet local hunting laws, and is reversible so that the hunter can choose which to expose, hunter orange or camouflage by either first donning the band, or inverting the band if already donned.

12 Claims, 2 Drawing Sheets

METHOD OF USING REMOVABLE ARM BAND FOR SAFETY PURPOSE IN HUNTING

This application claims priority from provisional application Nos. 60/296,133 filed on Jun. 7, 2001, Ser. No. 60/259,673 filed on Jan. 5, 2001, and 60/259,212 filed on Jan. 3, 2001 under 35 USC 119(e).

FIELD OF THE INVENTION

The present invention is directed to hunting apparel, and in particular, to a reversible elasticized band having hunter's orange material on one side and a camouflage material on the other side, the band adapted to be worn on the arm or other body part of a hunter.

BACKGROUND ART

Local hunting laws require hunters to wear hunter orange apparel while hunting. The apparel can take the form of a vest, a hat, a jacket, pants, or the like. Certain garments incorporate patches of hunter orange in the garment itself.

Besides wearing hunter orange apparel, the area of hunter orange material must also meet hunting laws. For example, in Alabama, the hunter orange apparel must be at least 144 square inches.

One problem with wearing hunter apparel is that some hunters only wish to wear the orange during the actual hunt, and do not care to wear the orange when not hunting, e.g., traveling to or leaving the hunt area. The presently available apparel does not leave the hunter much option in easily removing the hunter orange apparel.

Thus, a need exists for improved hunter orange hunting apparel that facilitates the use of the required area of hunter orange, but at the same time allows the hunter flexibility in using the hunter orange apparel at the desired time. The present invention solves this need by providing a reversible band, which allows the hunter to expose either camouflage or hunter orange without having to remove the band.

Bands for hunting have been proposed as seals against the ingress of tick, chiggers, and the like into hunter's boots. These bands are made of camouflage material, and are sized to fit over the top of a hunter's boot and to seal the boot opening against unwanted insects. The bands are not designed of hunter orange, are not reversible, and are not sized to display the appropriate area of hunter orange to meet local hunting laws.

SUMMARY OF THE INVENTION

It is a first object of the present invention to provide an improved hunter orange hunting apparel.

Another object of the invention is to provide hunting apparel that allows a hunter to easily shift between wearing the required amount of hunter orange for hunting, and a camouflage or other hunting-like material in situations where hunter orange apparel is not required.

Another object of the invention is an improved method of hunting wherein the hunter dons the inventive apparel and then inverts it to the desired side.

Other objects and advantages of the present invention will become apparent as a description thereof proceeds.

In one embodiment, the hunting apparel comprises a band having opposing ends and a sidewall, and an outer surface and an inner surface, the outer surface being hunter orange and the inner surface having a camouflage appearance, the outer surface being sized to expose a minimum area of hunter orange to meet hunting law requirements.

The band can be held in place in a number of ways. The sidewall could be made with opposing sides wherein fasteners are used to connect the opposing sides together to form a tubular sidewall and surround a body part of a hunter. Alternatively, one or both opposing ends of the band are elasticized to keep the band in place when surrounding a body part of a hunter. The material of the band can be elasticized to keep the band in place when surrounding a body part of a hunter.

The outer surface can be part of one layer of material, and the inner surface is part of another layer of material.

The band is preferably sized in length and circumference to surround an upper arm part of the hunter, and more particularly, have a length and circumference, wherein the length ranges between about 5 and 10 inches and the circumference ranges between about 15 and 30 inches.

The camouflage appearance can be one of a solid color or a combination of two or more colors.

The invention also entails an improvement in a method of hunting wherein a hunter must don hunter orange apparel. The improvement comprises providing a band having opposing ends and a sidewall, and an outer surface and an inner surface. The outer surface is hunter orange and the inner surface has a camouflage appearance, the outer surface being sized to expose a minimum area of hunter orange to meet hunting law requirements. The band is put on a part of a hunter's body with either the hunter orange exposed or the camouflage exposed. Then, the band can be inverted so the if the hunter orange is first exposed, the inverting step exposes the camouflage, and if the camouflage is first exposed, the inverting step exposes the hunter orange. The method also entails further inverting the band so that whatever is first exposed is again exposed.

Another set of bands is disclosed which combines school or other institutional colors, wherein one band has one color and the other band has the other color. Further yet, the band can be made of all hunter orange so there is no need to invert the band for a particular look.

BRIEF DESCRIPTION OF THE DRAWINGS

Reference is now made to the drawings of the invention wherein.

DESCRIPTION OF THE PREFERRED EMBODIMENTS

The present invention offers significant improvement in hunting apparel employing hunter orange. The invention allows a hunter to easily switch between a hunter orange look, and another look, e.g., camouflage, another pattern or a non-hunter orange color.

Figure 1:
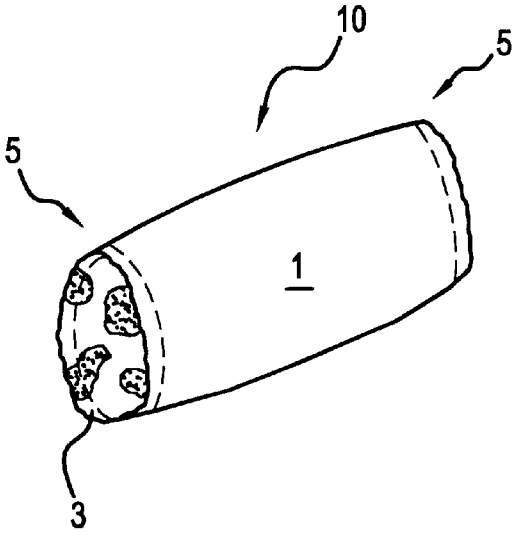
FIG. 1 shows a perspective view of one embodiment of the invention.
Figure 2:
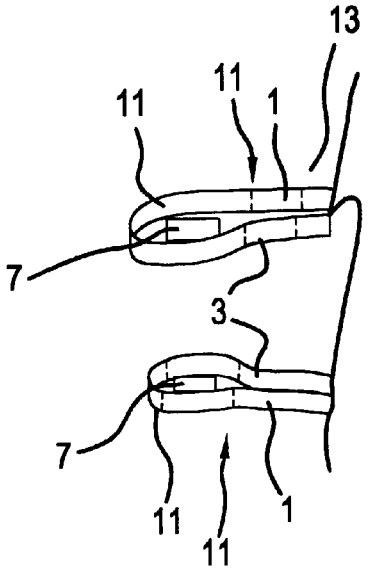
FIG. 2 is a schematic view of one end of the band of FIG. 1.

FIG. 1 shows one embodiment of the invention, a band designated by the reference numeral 10. The band 10 is shown with an exterior 1 made of a hunter orange material, and an interior 3 made of a camouflage material. The band 10 has elasticized ends 5. The elasticity can be attained by sewing in elastic bands 7 in between the exterior 1 and interior 3 as shown in FIG. 2. FIG. 2 also shows stitching 11 to keep the elastic in place. Other stitching 13 can be employed to ensure that the interior 3 and exterior 1 remain together for the most part. It should be understood that other types of elasticizers can be employed in the band ends 5 in place of the elastic 7 as would be known in the art, e.g., elasticized strings rather than bands. The ends 5 can employ any structure that would allow the band 10 to be inserted over clothing worn by a hunter, and retain the band in place, so that it does not fall off the hunter.

The camouflage material is intended to encompass a material that has markings, patterns, or the like that blends in the surroundings that hunters find themselves in when hunting. One example is that shown in FIG. 1, but other types employing random marking or even solid colors such as a brown or green can be utilized as part of the interior 3 of FIG. 1.

Figure 3:
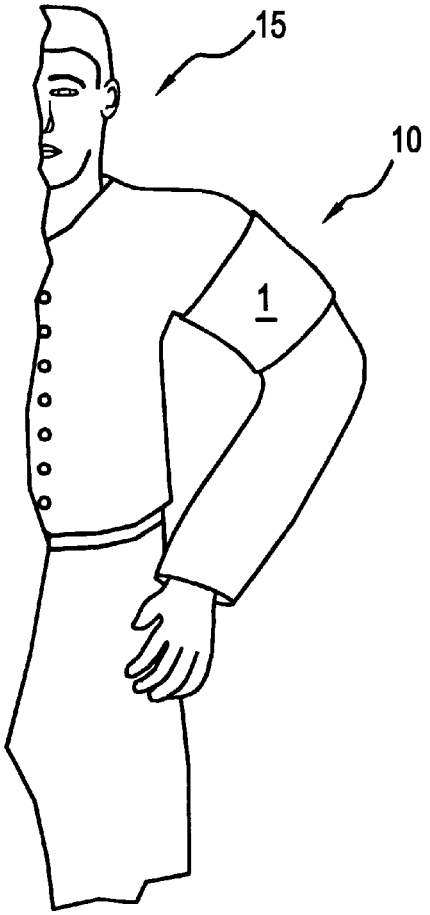
FIG. 3 shows the band of FIG. 1 in an exemplary use.

The elasticized ends 5 function to keep the band in place when surrounding a body part of a hunter. In FIG. 3, the band is shown on the upper arm of a hunter 15. However, the band could be sized to fit around a hunter's leg, torso, forehead, neck, or other body part.

The band 10 is sized so that the hunter orange has the required area to meet local hunting laws. For example, the band could be 8 inches in length, and have a circumference of 20 inches, for a total area of hunter orange of 160 sq. in. A band of this size would meet a hunting law requiring 144 sq. in. of hunter orange area. Of course, depending on the body part that the band is to surround, the band could have a larger circumference and shorter length, e.g., to fit around a hunter's waist.

The interior 3 can be any material, but is preferably a camouflage material. By using camouflage, the hunter can then reverse the band so that the camouflage is shown and the hunter orange is hidden. This option provides significant advantages in that the band does not have to be removed once it is donned by the hunter. The hunter merely has to reverse the band so that the camouflage material of the layer 3 is shown. This eliminates the possibility of losing the hunting apparel, which is a problem with prior art apparel that does not employ the features of the invention.

The interior 3 can be made of a material that aids in keeping the band in place on the hunter's body. For example, the camouflage 3 can be made of a fleece material. This fleece material has better holding power against a cloth outer garment due to friction and static electricity build-up. Of course, the camouflage material can be any type of material, even though fleece is a preferred type.

The invention also entails the method of using the band wherein the hunter would don the band in preparation of the hunt with the camouflage side exposed or even the hunter orange side exposed. The hunter could then roll one band end 5 over the band itself until the band 10 is inverted and either the hunter orange side is exposed when hunting, or the camouflage size is exposed. When initially having the camouflage side exposed, and inverting the band to the hunter orange side, the band 10 could again be inverted so that the camouflage side is exposed. With this method, the hunter does not have to remove the band 10 and risk losing it, but always has the capability to switch between a camouflage look and hunter orange depending on the hunter's circumstances.

Figure 4:
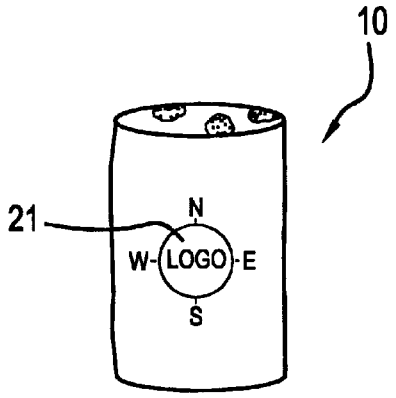
FIG. 4 is the band of FIG. 1 with an exemplary logo.

The band 10 could also employ a logo 21 as shown in FIG. 4, whereby a manufacturer could identify itself, e.g., Smith's Reversible. Other indicia could also be employed such as N, S, E, and W, as also depicted in FIG. 4.

Figure 5A:
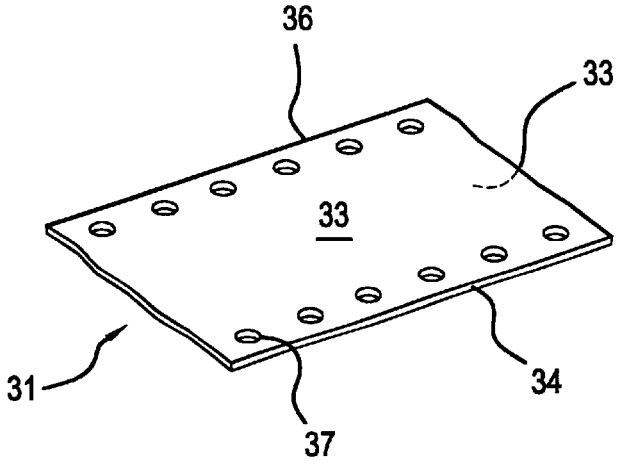
FIGS. 5*a* and 5*b* show another embodiment of the invention.
Figure 5B:
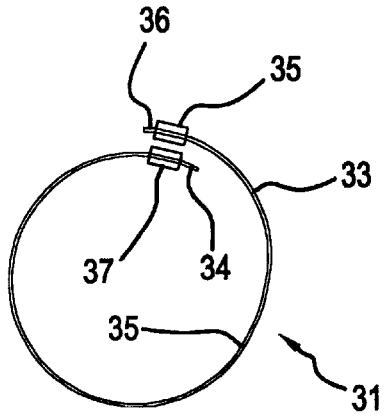

FIGS. 5*a* and 5*b* show another embodiment of the invention 30 wherein instead of a one piece band, the band 31 is made in a square or rectangular shape, one side 33 having a hunter orange color, with the other side 35 having the camouflage. The ends 34 and 36 are fastened by any known fastening devices, hook and loop fasteners, magnets, straps, string, clamps, snaps, buckles or the like. In FIG. 5*a*, the fasteners are shown as magnets 37 to minimize noise in the hunting environment when reversing or removing the band 31. As noted above, other fasteners could be used to in place of the magnets. FIG. 5*b* shows the band with the ends 34 and 36 connected for wearing by a hunter. In this embodiment, as in the others, the band could be sized to surround any body part, torso, head, leg, arm, etc.

In yet another embodiment, the band would be ring or tubular shaped as in FIG. 1, but could be made of an elastic material or materials such as that used for sweat bands or the like. In if this embodiment, there would be no need for the elasticized ends shown in the FIG. 1 embodiment, and no need for fasteners as shown in FIGS. 5*a* and 5*b*.

In still a further embodiment, the band could be made of one fabric or material, wherein the hunter orange would be on one side and the camouflage would be on the other side, thus avoiding the need to have two materials as shown below. This embodiment can be made by applying the appropriate color or pattern to a single fabric using methods know to be within the skill of the artisan, or using other known methods of making fabric material with different colors or patterns on opposing surfaces.

Figure 6A:
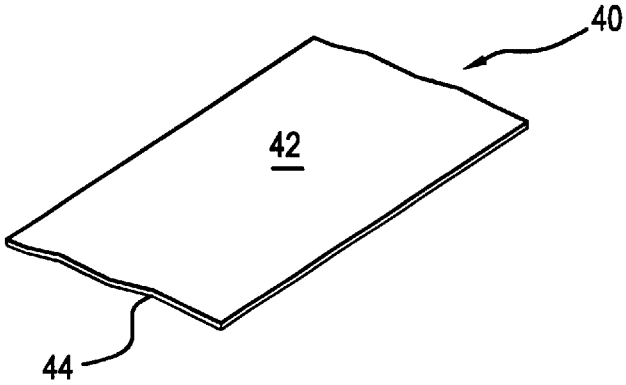
FIGS. 6*a* and 6*b* show the bandanna embodiment of the invention.
Figure 6B:
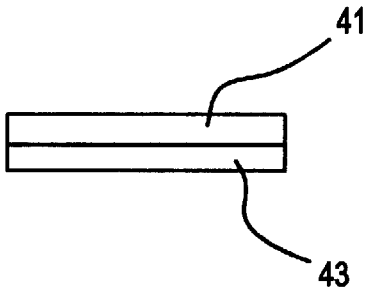

One other embodiment of the invention is a reversible bandana as shown in FIGS. 6*a* and 6*b*. The bandana 40 is shown in a rectangular shape but could have other shapes. Again the hunter orange surface 42 would be sized to meet local hunting laws, with the opposing surface 44 being camouflage. The bandana 40 could be made with one material 41 sewn or otherwise attached to a second material 43 as shown in the section of material depicted in FIG. 6*b*. The material 41 would provide the hunter orange surface 42, with the material 43 providing the camouflage surface. In this embodiment, the hunter merely has to wrap the bandana around a body part with either the hunter orange surface 42 exposed, or the camouflage surface 44 exposed, and alternate between the surfaces as need or desire arises.

Another invention encompasses a method of displaying school or team colors using arm bands, particularly elasticized types. The method entails making one band with one school or team color and at least one other band with another team or school color. For example, the two bands could be brown and orange and be worn by a Cleveland Browns fan. Alternatively, the bands would be crimson and white to represent Alabama. The bands can be made of any material that can display the selected color and can be elasticized or can use some type of fastener, e.g., hook and loop, to be worn by an individual. The individual can wear one band on one arm or leg and another band on another arm or leg, or other body part as well. The invention also entails the bands and selected colors in combination as well. In yet another embodiment, the band can be made of just hunter orange material rather than a dual material design. In this way, there is no danger of forgetting to reverse the material from the camouflage side to the hunter orange side. The band can employ any of the attachment features noted above for the dual purpose band.

As such, an invention has been disclosed in terms of preferred embodiments thereof which fulfills each and every one of the objects of the present invention as set forth above and provides new and improved hunting apparel and a method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a method of hunting wherein a hunter must don hunter orange apparel for safety purposes, the improvement comprising:

a) providing a band having opposing elasticized ends and a sidewall, and an outer surface and an inner surface, the outer surface being hunter orange and the inner surface having a camouflage appearance, the outer surface being sized to expose a minimum area of hunter orange to meet hunting law requirements, the opposing elasticized ends being sized to fit over a hunter's arm;

b) sliding the band over a portion of clothing covering a hunter's arm with either the hunter orange exposed or the camouflage exposed, the elasticized ends sized to surround the clothing and keep the band in place and covering the clothing;

c) inverting the band so that if the hunter orange is first exposed, the inverting step exposes the camouflage, and if the camouflage is first exposed, the inverting step exposes the hunter orange; and d) then removing the band from the clothing.

2. The method of claim 1, comprising further inverting the band so that whatever is first exposed is again exposed.

3. In a method of hunting wherein a hunter must don hunter orange apparel for safety purposes, the improvement comprising:

a) providing a band having opposing elasticized ends and a sidewall made of a hunter orange material, the sidewall being sized to expose a minimum area of hunter orange to meet hunting law requirements, the band being sized to fit over a hunters arm;

b) sliding the band over a portion of clothing covering a hunter's arm, the elasticized ends sized to surround the clothing and keep the band in place and covering the clothing during hunting; and d) removing the band from the clothing after hunting.

4. The method of claim 3, wherein the sidewall is a hunter orange fleece material.

5. The method of one of claim 3, wherein the band has a length and circumference and the length ranges between about 5 and 10 inches and the circumference ranges between about 15 and 30 inches.

6. The method of claim 3, wherein the outer surface is part of one layer of material, and the inner surface is part of another layer of material.

7. The method of claim 3, wherein the band is sized in length and circumference to surround an upper arm part of the hunter.

8. The method of one of claim 1, wherein the band has a length and circumference and the length ranges between about 5 and 10 inches and the circumference ranges between about 15 and 30 inches.

9. The method of claim 1, wherein the outer surface is part of one layer of material, and the inner surface is part of another layer of material.

10. The method of claim 1, wherein the band is sized in length and circumference to surround an upper arm part of the hunter.

11. The method of claim 1, wherein the arm band is elasticized on its ends only.

12. The method of claim 1, wherein the arm band is elasticized on its ends only.

* * * * *